United States Patent [19]

Jones et al.

[11] 4,248,006

[45] Feb. 3, 1981

[54] RECONFIGURABLE MOVING ANIMAL SIMULATING TOY

[75] Inventors: Lawrence T. Jones, Playa Del Rey; Anson Sims, Granada Hills; Ashley G. Howden, Los Angeles; Robert S. Lee, West Lake Village, all of Calif.

[73] Assignee: California R & D Center, Culver City, Calif.

[21] Appl. No.: 10,827

[22] Filed: Feb. 9, 1979 (Under 37 CFR 1.47)

[51] Int. Cl.[3] ..... A63H 33/06; A63H 17/04; A63H 11/00; A63H 11/10

[52] U.S. Cl. ..... 46/17; 46/219; 46/215; 46/202; 46/251; 46/106; 46/223; 46/123

[58] Field of Search ..... 46/219, 223, 251, 252, 46/253, 264, 265, 266, 256, 17, 215, 106, 202, 201, 16; 222/79

[56] References Cited

U.S. PATENT DOCUMENTS

| | | | |
|---|---|---|---|
| 2,758,418 | 8/1956 | Troppe | 46/202 |
| 3,363,362 | 1/1968 | Jolley | 46/253 |
| 3,587,191 | 6/1971 | Cooper | 46/119 |
| 3,789,541 | 2/1974 | Good et al. | 46/215 |
| 3,849,931 | 11/1974 | Gulley, Jr. | 46/206 |
| 4,051,623 | 10/1977 | Ogawa | 46/120 |
| 4,095,367 | 6/1978 | Ogawa | 46/120 |
| 4,095,368 | 6/1978 | Saito | 46/219 |
| 4,144,669 | 3/1979 | Ogawa | 46/223 |
| 4,150,508 | 4/1979 | Ogawa | 46/223 |

FOREIGN PATENT DOCUMENTS

| | | | |
|---|---|---|---|
| 1229003 | 3/1960 | France | 46/264 |

*Primary Examiner*—F. Barry Shay
*Assistant Examiner*—Michael J. Foycik, Jr.
*Attorney, Agent, or Firm*—Jackson, Jones & Price

[57] ABSTRACT

A toy having an upper and a lower body section is disclosed. The lower body section is operatively attachable to the upper body section in a plurality of configurations. A container capable of holding a liquid is included in the upper body section. A compressable bellow, and a nozzle is operatively connected to the container whereby the liquid may be squirted out from the toy at the option of a player. The lower body section includes an electric motor and a track assembly which is capable of locomoting the toy in any of the possible configurations assembled at the option of the player.

17 Claims, 9 Drawing Figures

FIG. 8
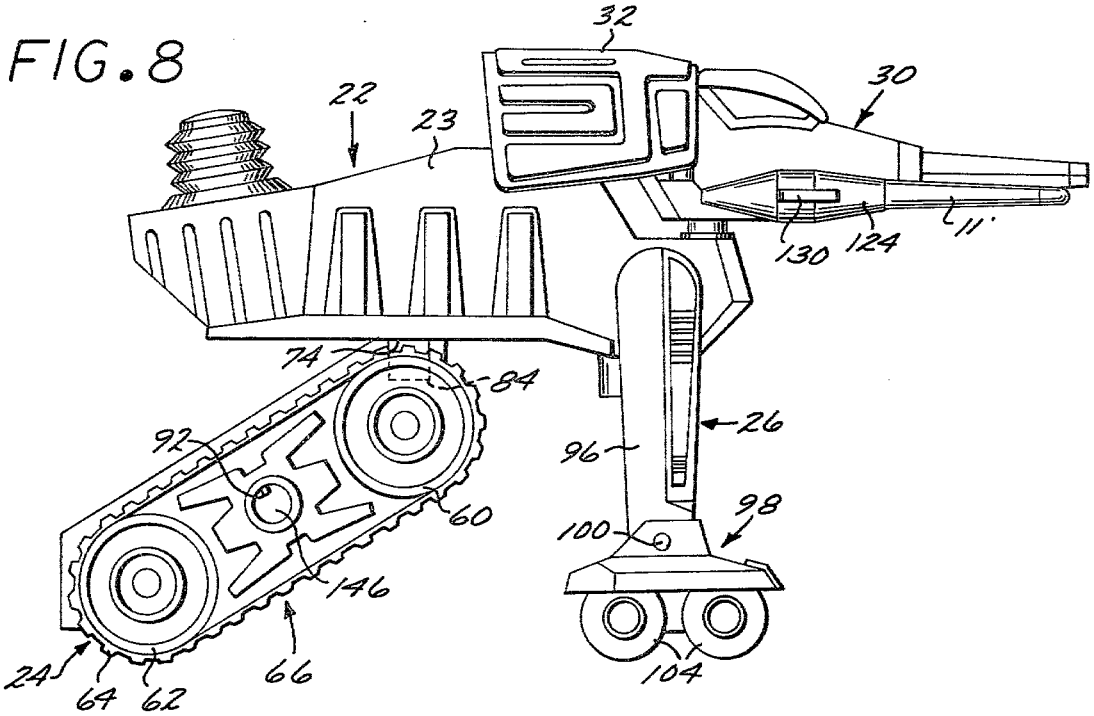
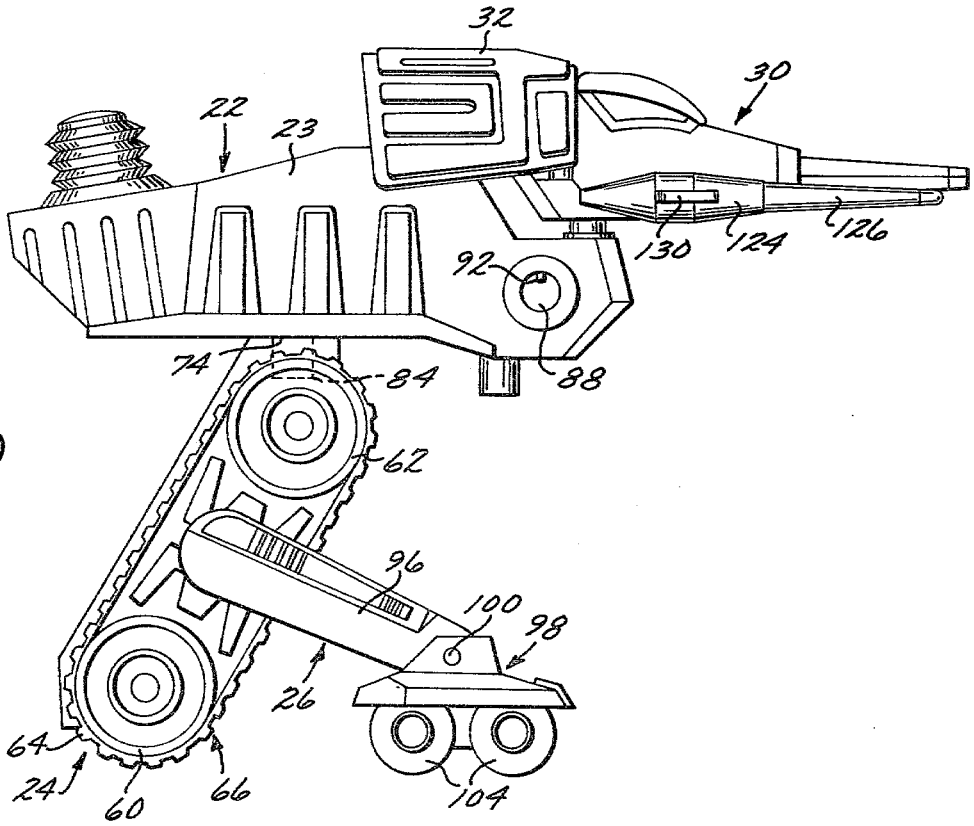
FIG. 9

RECONFIGURABLE MOVING ANIMAL SIMULATING TOY

BACKGROUND OF THE INVENTION

1. Field of the Invention

The present invention relates to a toy configured to simulate an animal such as an elephant, and more particularly to a self-propelled toy in which various component parts may be assembled in a plurality of configurations to propel the toy on a support surface.

2. Brief Description of the Prior Art

The prior art is well aware of toys configured to simulate various animals.

The prior art is also aware of toys wherein several component parts may be reconfigured to form a second toy. Examples of such reconfigurable toys may be found in U.S. Pat. Nos. 4,132,028; 4,090,321; 4,051,623 and 4,057,929.

Notwithstanding the present availability of a large variety of toys, the toy industry is constantly striving to create new toys which provide novel play options, and appeal to the creative imagination of the children playing with the toys. Accordingly, there is a need in the toy manufacturing arts for a moving animal simulating toy having the features of the toy of the present invention.

SUMMARY OF THE INVENTION

It is an object of the present invention to provide a toy which simulates a science fiction image of an animal such as an elephant.

It is another object of the present invention to provide a self-propellable toy, the component parts of which may be reconfigured to form other self-propellable toys.

It is still another object of the present invention to provide a toy having reconfigurable parts, which can eject water at the option of a player.

It is yet another object of the present invention to provide a toy having reconfigurable parts which is capable of receiving a plurality of toy appendages.

These and other objects and advantages are attained by a toy having an upper and a lower body section. The lower body section includes at least one drive member which is capable of propelling the toy on a support surface. The lower body portion is attachable to the main body portion in a plurality of configurations. The drive member, which in the preferred embodiment comprises a track belt, is adapted for driving the toy in each of these configurations. A bellow and nozzle assembly is provided in the upper body section to eject a liquid such as water at the option of a player. The liquid may be ejected through an elongated member which simulates a trunk of an elephant.

The objects and features of the present invention are set forth with particularity in the appended claims. The present invention may be best understood by reference to the following description, taken in connection with the accompanying drawings in which like numerals indicate like parts.

BRIEF DESCRIPTION OF THE DRAWINGS

FIG. 8 is a side view of a first alternative configuration of the preferred embodiment of the toy of the present invention; and FIG. 9 is a side view of a second alternative configuration of the preferred embodiment of the toy of the present invention.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventor for carrying out his invention in a commercial environment, although it should be understood that various modifications can be accomplished within the parameters of the present invention.

Figure 1:
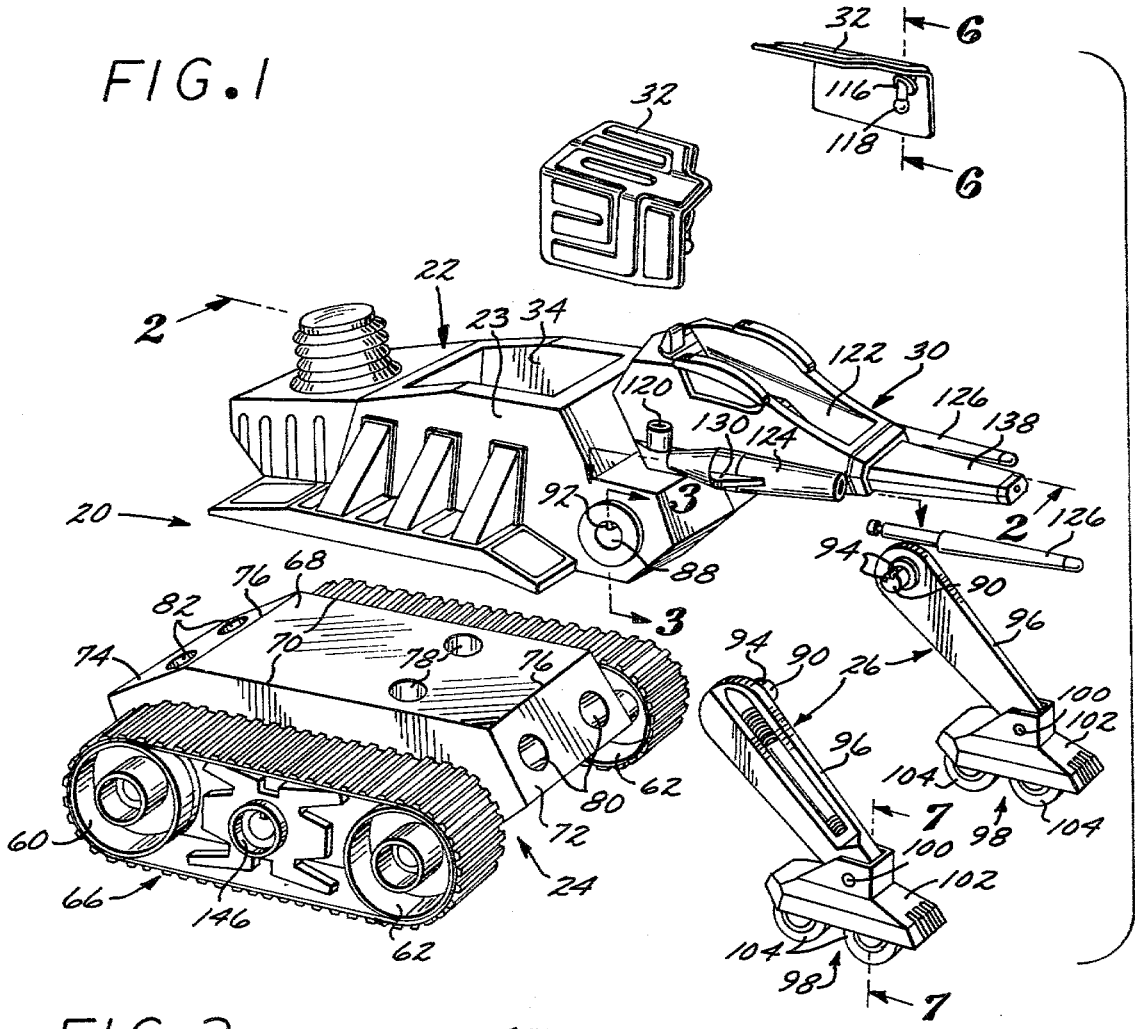
FIG. 1 is an exploded perspective view of the preferred embodiment of the toy of the present invention.
Figure 2:
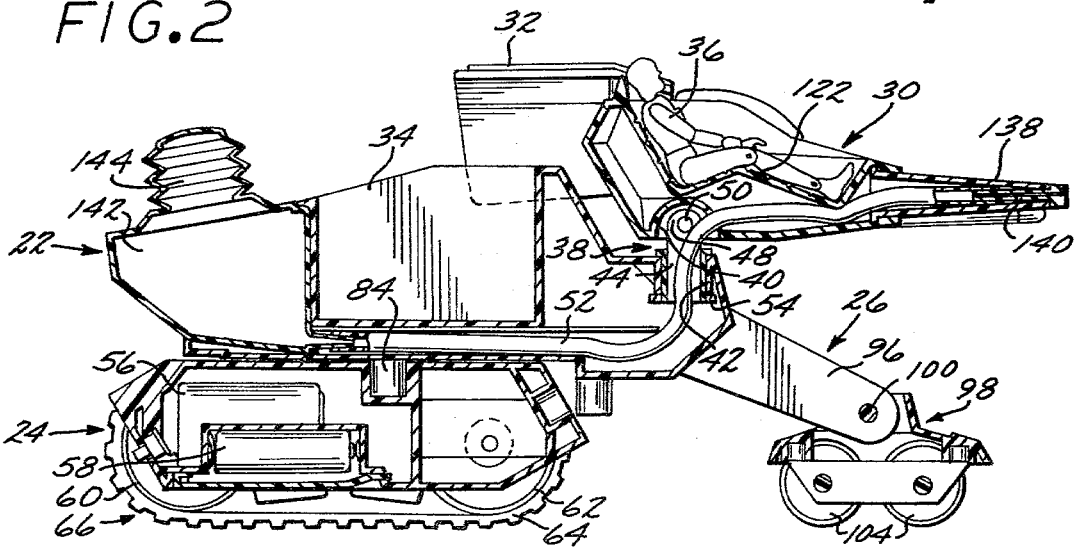
FIG. 2 is a cross sectional view of the preferred embodiment of the toy of the present invention, the cross section being taken at lines 2—2 of FIG. 1.

Referring now to the drawings and particularly to FIGS. 1 and 2, a preferred embodiment of the toy 20 of the present invention is disclosed. The toy 20 comprises an upper body section 22 and a lower body section 24. Front leg members 26 are removably mounted to either side 28 of the upper body section 22. The upper body section 22 includes a frontal portion or member 30 which is configured to simulate an elephant head. Ear members 32 are removably mounted to either side of the frontal portion or member 30.

As is shown in FIG. 1, the upper body section 22 is generally configured to simulate an upper body of what is best described as a science-fiction conception of an elephant. The upper body 22 is conveniently molded from suitable plastic material such as high impact polystyrene. Generally speaking, the several component parts of the toy of the present invention may be readily manufactured from high impact polystyrene, although various other plastic materials may also be suitable for this purpose.

The upper body 22 incorporates a relatively large, rectangularly shaped cavity 34. Various toy appendages such as a toy doll 36, shown on FIG. 2, and others (not shown) may be placed in the cavity 34. The frontal portion 30 is pivotably mounted to the rest of the upper body section 22 through a universal joint 38.

The universal joint 38, shown in the cross sectional view of FIG. 2, includes a substantially circularly shaped bearing surface 40 integrally molded with the frontal portion 30, and a circular aperture 42 incorporated in the lower body section 24. A hollow plug 44 having a substantially cylindrical body 46 and a spherical head 48 is rotatably held within the circular aperture 42. The spherical head 48 interfaces with the bearing surface 40, and a cross bolt or pin 50 pivotably attaches the spherical head 48 to the frontal portion 30. A flexible hose 52, the purpose of which is described below, is led through the hollow plug 44 from the frontal portion 30 into the rest of the upper body section 22. A circular flange 54 provided on the bottom of the cylindrical body 46 interfaces with the walls of the circular aperture 42 and thereby prevents accidental removal of the plug 44 from the circular aperture 42.

Still referring to FIGS. 1 and 2, the lower body section 24 is disclosed in detail. It serves as a housing for an electric motor 56, a battery 58, a suitable gear train (not shown) as well as the principal support for the upper body section 22. The lower body section 22 includes rear wheels 60 and front wheels 62 mounted on either side of the lower body section 22. An endless belt 64 having a ridged outer surface, best shown in FIG. 1, connects the respective rear 60 and front wheels 62 on either side of the lower body section 22. In the preferred embodiment of the toy 20 described here, the rear wheels 60 are driven by the electric motor 56 through the gear train (not shown). The wheels 60 and 62 together with the endless belt 64 comprise a track assembly, generally designated as 66. This track assembly 66 propels the toy 20 on a support surface (not shown). A switch (not shown) mounted to the lower body section 24 enables a player to turn the motor 56 on and off.

As is best shown on FIG. 1, the lower body section 24 includes a substantially flat, horizontally disposed rectangular upper surface 68. Two longer sides 70 of the rectangular surface 68 are disposed parallel with the endless belts 64. A first 72 and a second inclined surface 74 abut each shorter side 76 of the rectangular surface 68. Both the first 72 and the second 74 inclined surfaces meet the rectangular surface 68 at an obtuse angle, however the respective obtuse angles are not identical. The purpose of this particular configuration of the rectangular 68, first 72 and second 74 surfaces of the lower body section 24 will be understood as the toy 20 of the present invention is further described below.

Referring still to FIGS. 1 and 2, the mounting of the upper body section 22 to the lower body section 24 is disclosed. The lower body section 24 includes a pair of circular apertures 78 in the horizontally disposed rectangular surface 68. Pairs of similar circular apertures designated as 80 and 82 are provided respectively in the first 72 and second 74 inclined surfaces. Two cylindrical plugs 84 protrude downwardly from a bottom surface 86 of the upper body section 22. One of the two cylindrical plugs 84 is shown in FIG. 2 and is also shown with phantom lines on FIGS. 8 and 9.

The cylindrical plugs 84 are spaced to align with the circular apertures 78, and are friction fitted therein. Thus, in the configuration of the toy 20 shown in FIGS. 1 and 2 the upper body section 22 is attached to the lower body section through the cylindrical plugs 84. In alternative configurations of the toy 20, shown in FIGS. 8 and 9, the cylindrical plugs 84 serve the same purpose; except that in these configurations the plugs 84 are attached to the respective circular apertures 82 and 80. These alternative configurations of the toy 20 are further described below.

Figure 3:
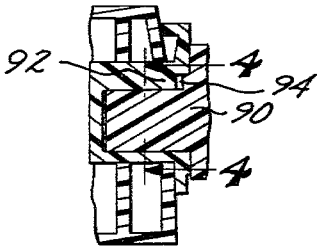
FIG. 3 is a cross sectional view of a front leg attaching assembly of the preferred embodiment of the toy of the present invention, the cross section being taken at lines 3—3 of FIG. 1.
Figure 4:
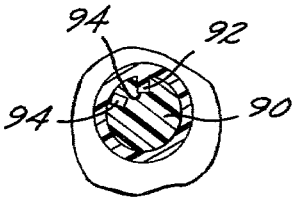
FIG. 4 is a cross sectional view of the front leg attaching assembly of the preferred embodiment of the toy of the present invention, the cross section being taken at lines 4—4 of FIG. 3.

Referring now to FIGS. 1, 2 and 8 also to the cross sectional views of FIGS. 3 and 4, the removable mounting of the two front leg members 26 to the respective lateral sides 28 of the upper body section 22, is disclosed. Each lateral side includes a circular aperture 88 into which a plug 90 located on each front leg member 26 is friction fitted. A rib 92, best shown in the cross sectional view of FIG. 4, is provided within the circular aperture 88. The rib 92 is disposed parallel with the general longitudinal axis of the apertures 88.

The plug 90 includes a pair of slots 94, best shown in FIG. 1, which are dimensioned to interface with the rib 92. The positioning of the slots 94 is such that the plug 90 may be inserted into the aperture 88 in one of two configurations selected at the option of a player. These configurations, wherein the front leg member 26 describes an obtuse and a right angle relative to the upper body section 22, are respectively shown in FIGS. 1 and 8. As is readily apparent from the above description, when the plug 90 is inserted and therefore friction fitted in the aperture 88, the rib 92 engages one of the slots 94. Therefore the front leg members 26 are not pivotable relative to the upper body section 22.

Each front leg member 26 includes a substantially lever shaped member 96 to which the plug 90 is attached. A caster or wheel assembly 98 is pivotably mounted to one end of the lever shaped member 96. A cross bolt or pin 100 pivotably secures a wheel assembly housing 102 to the lever shaped member 96.

Figure 7:
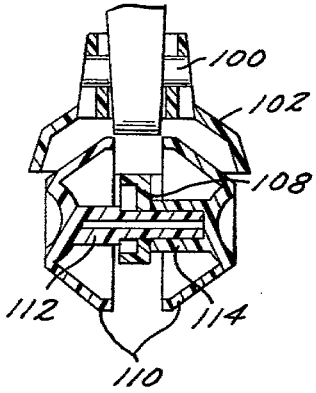
FIG. 7 is a cross sectional view of a wheel assembly of a front leg member of the preferred embodiment of the toy of the present invention, the cross section being taken at lines 7—7 of FIG. 1.

Each wheel assembly 98 includes 2 wheels 104, shown in FIGS. 1, 2, 8 and 9. The wheels 104 are pivotably suspended in the wheel assembly housing 102 on a support member 108. Each wheel 104 comprises two wheel sections 110, shown in FIG. 7, each of which includes a wheel axle 112 and 114. One of the wheel axles 114 includes an aperture into which the other wheel axle 112 may be snap fitted. Thus, two wheel sections 110 are mounted to one another through their axles 112 and 114, and the joined axles 112 and 114 are rotatably mounted in an aperture provided in the support member 108.

Figure 6:
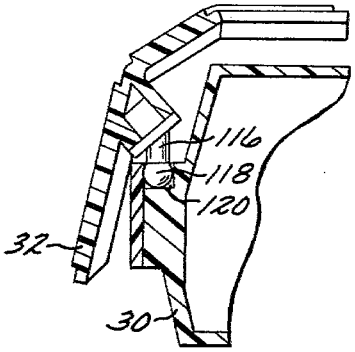
FIG. 6 is a cross sectional view showing an attachment of an ear member to an upper body section of the preferred embodiment of the toy of the present invention, the cross section being taken at lines 6—6 of FIG. 1.

Referring now to FIGS. 1, 2 and 6, the mounting of the ear members 32 to the upper body section 22 is disclosed. Each ear member 32 comprises 3 stylized panel members angularly joined to one another, as is best shown on FIG. 6. A cylindrical plug 116 which terminates in a ball shaped head 118, is attached to each ear member 32. The ball shaped heads 118 are received in circular apertures 120 located on either side of the frontal portion 30 comprising the elephant's head. The ball shaped head 118 is somewhat larger in diameter than the cylindrical plug 116. Therefore, as is readily apparent from the above description together with an inspection of FIG. 7, each ear member 32 is capable of a limited pivoting movement about a horizontal and a vertical axis.

A top surface 122 of the frontal portion 122, i.e. the elephant head, is configured to form a seat, as is shown on FIGS. 1 and 2. The toy doll 36 may be seated on the seat. Therein it is partially covered by the ear members 32, which simulate a canopy.

Figure 5:
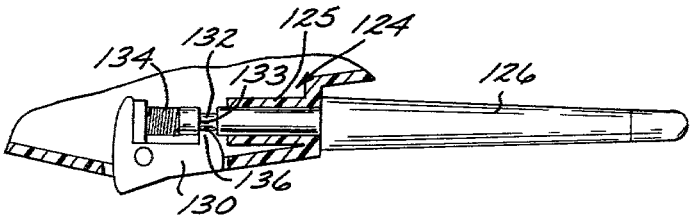
FIG. 5 is a view, partly in cross section, of a spring loaded projectile launcher of the preferred embodiment of the toy of the present invention, the cross section being taken at lines 5—5 of FIG. 1.

Referring now to FIGS. 1 and 5, a pair of toy missile launchers 124 attached to either sides of the frontal portion 30, are disclosed. Each missile launcher 124 together with a toy missile or projectile 126 effectively simulates an elephant tusk. A tubular housing 128 of the missile launcher 124 is integrally constructed with the frontal portion 30. The tubular housing 128 includes a slot through which a pivotably mounted trigger piece 130 enters the housing 128. An elongated body of the toy missile 126 includes a cylindrical section 132 which forms a ridge 133. The missile 126, when inserted into the tubular housing 128, compresses a coil spring 134. A narrow portion 136 of the trigger piece 130 engages the ridge 133 formed on the cylindrical section 132 and retains the toy missile 126 within the housing 128. When the trigger piece 130 pivots as a result of being pressed by a player, the narrow portion 136 of the trigger piece 130 disengages the ridge 133. Consequently the toy missile 126 is launched forward by the coil spring 134.

Referring now to FIGS. 1 and 2 and particularly to the cross sectional view of FIG. 2, a water ejecting assembly of the preferred embodiment of the toy 20 of the present invention is disclosed. The frontal portion 30 includes a pointed, tubular member 138 which is configured to simulate a trunk of an elephant. A nozzle 140 is incorporated in the tubular member 138. A container 142 including a bellow 144 is disposed in a rear portion of the upper body section 22. The bellow 144 is made from flexible plastic material such as polyethylene. The flexible hose 52, briefly mentioned above, connects the container 142 with the nozzle 140.

Water (not shown) is placed into the container 142 through a hole (not shown) provided in the bellow 144 in such a manner that the level of the water is below the height of the nozzle 140. A small plug (not shown) is provided to plug the hole (not shown) in the bellow 144. As a player compresses the bellow 144, the resulting air pressure ejects water through the nozzle 140. This in effect, simulates an elephant squirting out water through its trunk.

Having described the several component parts of the toy 20 of the preferred embodiment of the present invention, particular reference is made to FIGS. 8 and 9 wherein a first and a second alternative configuration of the toy 20 are disclosed. Each of these alternative configurations is readily assembled by a child player.

The first alternative configuration, shown on FIG. 8, is assembled by inserting the cylindrical plugs 84 of the upper body section 22 into the apertures 82 provided in the second inclined surface 74. The front leg members 26 are then mounted and locked to the lateral side 28 of the upper body section 22 at a right angle, as described above.

In the second alternative configuration of the toy 20, shown on FIG. 9, the cylindrical plugs 84 are inserted into the apertures 80 provided in the first inclined surface 72. The front leg members 26 are then mounted to and locked in apertures 146 provided on each side of the lower body section 24. The apertures 146 include a rib 92, as do the apertures 88, so that the front leg members are locked in position when attached to the lower body section 24. Because the wheel assembly housing 102 is capable of a pivoting movement about a horizontal axis relative to the lever shaped member 96 of each front leg 26, the wheels 104 are disposed level, in contact with a support surface (not shown) in these alternative configurations. Movement of the endless belt 64 of the track assembly 66 propels the toy 20 along a support surface in these alternative configurations, as well as in the configuration illustrated in FIGS. 1 and 2.

The play options provided by the toy 20 of the preferred embodiment of the present invention are readily apparent. These include assembling the toy 20 in the above described alternative configurations, turning on the motor 56 thereby propelling the toy along a support surface, placing the toy doll 36 in the seat, pivoting the ear members 32, squirting water through the trunk and placing various toy objects into the cavity 34.

Several modifications of the toy 20 may be apparent to those skilled in the toy manufacturing arts in light of the generic principles taught herein. A particularly apparent modification is to configure the several component parts of the toy to simulate various animals other than an elephant. Accordingly, the scope of the present invention should be interpreted solely from the following claims.

What is claimed is:

1. A toy comprising:

an upper body section including a front portion configured to simulate an elephant head, the front portion having an elongated member configured to simulate a trunk, and including a seat adapted for receiving a toy figure for seating upon the seat;

a pair of ear members, each ear member being pivotably mounted to the front portion configured to simulate an elephant head and comprising at least two panel members angularly joined together, the ear members being further adapted to form a canopy over the seat; a lower body section to support the upper body section and having a plurality of joining surfaces so that the lower body section is operatively attachable to the upper body section in a plurality of configurations at the option of a player;

a pair of arm sections having attachment means for attachment to one of the upper and lower body sections in a plurality of configurations thereby defining a plurality of modes of attachment, each of said configurations attaching the arm sections to one of the upper and lower body sections corresponding to one of said modes of attaching the lower body section to the upper body section, in each of said configurations the lower body section and the pair of arm sections supporting the upper body section, and first means included in one of the upper and lower body sections for providing a capability of ejecting a liquid at the option of a player, the first means including a nozzle which is incorporated in the elongated member.

2. The toy of claim 1 wherein the first means further include a container incorporated in the upper body section, the container having a compressable bellows and a hose connecting the nozzle with the container.

3. The toy of claim 1 and wherein each arm section includes at least one wheel for rolling along the support surface.

4. The toy of claim 3 wherein each arm section is attachable to the upper body section at the option of the player in at least two fixed but removable positions.

5. The toy of claim 1 wherein the portion configured to simulate an elephant head includes two spring loaded projectile launchers, each projectile launcher retaining an elongated projectile, the projectile launcher having the projectile being configured to simulate an elephant tusk.

6. A reconfigurable toy comprising:

an upper body section configured to simulate an upper body of an elephant, the upper body section including a frontal section configured to simulate an elephant head and having a trunk shaped member;

a lower body section including at least three substantially flat joining surfaces, and being removably attachable to the upper body section at the option of a player so that any one of the joining surfaces is in contact with the upper body section thereby defining a plurality of modes of attachment, in each of said modes of attachment the toy having a different overall configuration;

a pair of wheeled arm sections having attaching means for attachment to the upper body section in at least two different but predetermined configurations, and to the lower body section in at least one predetermined configuration, each of said configurations of attaching the pair of arm sections to one of the upper and lower body sections corresponding to one of said modes of attaching the lower body section to the upper body section, in each of said configurations the lower body section and the pair of arm sections supporting the upper body section;

first means incorporated in the lower body section and adapted for allowing the toy to be rolled along a support surface in any one of the plurality of configurations in which the lower body section is attached to the upper body section.

7. The toy of claim 6 wherein the upper body section incorporates second means for ejecting a liquid through the trunk shaped member at the option of a player.

8. The toy of claim 6 wherein the first means comprise a track assembly including an endless track belt.

9. The toy of claim 6 wherein each joining surface includes at least one aperture and wherein the upper body section has at least one plug which is adapted to be friction fitted in the aperture of any one of the joining surfaces.

10. The toy of claim 6 further comprising a pair of ear shaped members, each ear shaped member being pivotably attachable to the frontal section.

11. The toy of claim 10 wherein the frontal section includes a seat for a toy figure.

12. The toy of claim 6 wherein the frontal section includes two tusk shaped members, each tusk shaped member including spring loaded means for retaining and for releasing a toy projectile at the option of a player.

13. A reconfigurable toy comprising:

a first body section;

a second body section incorporating roller means for allowing the toy to be propelled along a support surface, and a plurality of joining surfaces so that the second body section is operatively attachable to the first body section in a plurality of configurations;

and a pair of arm sections having attachment means for attachment to one of the first and second body sections in a plurality of configurations thereby defining a plurality of modes of attachment, each of said configurations attaching the arm sections to one of the first and second body sections corresponding to one of said modes of attaching the second body section to the first body section, in each of said configurations the second body section and the pair of arm sections supporting the first body section, and player actuated water means included in the first body section for providing a capability of ejecting water from the toy in each of the separate configurations.

14. The toy of claim 13 wherein the player actuated means include a container capable of containing the liquid, a compressable bellows operatively attached to the container, a nozzle, and a hose connecting the container with the bellows.

15. The toy of claim 14 wherein the toy is configured to simulate an elephant, the player actuated means are included in the first body section and the nozzle is incorporated in a trunk of the elephant.

16. The toy of claim 14 wherein the first body section includes a seat upon which a toy appendage may be positioned.

17. The toy of claim 16 further comprising two ear members, each ear member being pivotably mounted to the first body section, the ear members comprising a canopy over the seat.

* * * * *

UNITED STATES PATENT AND TRADEMARK OFFICE

CERTIFICATE OF CORRECTION

PATENT NO. : 4,248,006

DATED : February 3, 1981

INVENTOR(S) : Anson Sims et al

It is certified that error appears in the above—identified patent and that said Letters Patent is hereby corrected as shown below:

Column 4, line 1, after "8" insert --and--.

Column 5, line 68, after "toy" insert --20--.

Column 6, line 25, after "seat," commence a new paragraph with "a lower body section".

Signed and Sealed this

*Twenty-fourth* Day of *November 1981*

[SEAL]

*Attest:*

GERALD J. MOSSINGHOFF

*Attesting Officer*

*Commissioner of Patents and Trademarks*